US010450911B2

(12) United States Patent
Döring

(10) Patent No.: US 10,450,911 B2
(45) Date of Patent: Oct. 22, 2019

(54) EXHAUST GAS AFTERTREATMENT DEVICE AND EXHAUST GAS AFTERTREATMENT METHOD

(71) Applicant: MAN Diesel & Turbo SE, Augsburg (DE)

(72) Inventor: Andreas Döring, Unterhaching (DE)

(73) Assignee: MAN Energy Solutions SE, Augsburg (DE)

( * ) Notice: Subject to any disclaimer, the term of this patent is extended or adjusted under 35 U.S.C. 154(b) by 289 days.

(21) Appl. No.: 15/520,212

(22) PCT Filed: Oct. 21, 2015

(86) PCT No.: PCT/EP2015/074365

§ 371 (c)(1),
(2) Date: Apr. 19, 2017

(87) PCT Pub. No.: WO2016/071112

PCT Pub. Date: May 12, 2016

(65) Prior Publication Data

US 2017/0314434 A1 Nov. 2, 2017

(30) Foreign Application Priority Data

Nov. 6, 2014 (DE) ..... 10 2014 016 448

(51) Int. Cl.
*F01N 1/02* (2006.01)
*F01N 1/06* (2006.01)
(Continued)

(52) U.S. Cl.
CPC ..... *F01N 1/06* (2013.01); *F01N 1/02* (2013.01); *F01N 1/023* (2013.01); *F01N 1/161* (2013.01);
(Continued)

(58) Field of Classification Search
CPC ..... F01N 1/02; F01N 1/16; F01N 1/20; F01N 1/06; F01N 1/023; F01N 1/161;
(Continued)

(56) References Cited

U.S. PATENT DOCUMENTS 2,297,046 A * 9/1942 Bourne ..... F01N 1/006 110/184
5,014,816 A * 5/1991 Dear ..... F01N 1/02 181/229
(Continued)

FOREIGN PATENT DOCUMENTS

DE 19619173 7/1997
DE 19611133 9/1997
(Continued)

OTHER PUBLICATIONS

Office Action dated Jun. 19, 2018 which issued in the corresponding Korean Patent Application No. 10-2017-7013182.
(Continued)

*Primary Examiner* — Edgardo San Martin
(74) *Attorney, Agent, or Firm* — Cozen O'Connor

(57) ABSTRACT

An exhaust-gas aftertreatment device (10) for an internal combustion engine, particularly for a marine diesel internal combustion engine operated using heavy fuel oil, includes a housing (11); an exhaust-gas chamber (12) defined by the housing (11), for permitting exhaust gas to flow continuously through the housing (11), an inlet (13) for permitting exhaust gas to flow into the housing and an outlet (14) for permitting exhaust gas to flow out of the housing (11); a sound damping chamber (15), defined by the housing (11) and coupled with the exhaust-gas chamber (12). The sound dampening chamber (15) is constructed to receive a fluid or a pourable solid at a fill level depending on the frequency of an exhaust sound to be damped.

18 Claims, 4 Drawing Sheets

(51) Int. Cl.
*F01N 1/16* (2006.01)
*F01N 1/00* (2006.01)

(52) U.S. Cl.
CPC ..... *F01N 2230/02* (2013.01); *F01N 2230/04* (2013.01); *F01N 2490/12* (2013.01); *F01N 2590/02* (2013.01)

(58) Field of Classification Search
CPC .. F01N 1/003; F01N 2230/02; F01N 2230/04; F01N 2490/12; F01N 2490/14
See application file for complete search history.

(56) References Cited

U.S. PATENT DOCUMENTS

| | | | | |
|---|---|---|---|---|
| 5,103,931 | A | 4/1992 | Okazaki et al. | |
| 5,426,269 | A * | 6/1995 | Wagner | F01N 1/02 181/232 |
| 5,732,740 | A * | 3/1998 | Hornyack | F16L 55/053 138/26 |
| 6,009,705 | A * | 1/2000 | Arnott | F01N 1/02 123/184.57 |
| 6,158,214 | A | 12/2000 | Kempka et al. | |
| 6,634,457 | B2 * | 10/2003 | Paschereit | F01N 1/02 181/219 |
| 6,679,742 | B2 * | 1/2004 | Yokoya | B63H 21/32 181/264 |
| 6,808,433 | B1 | 10/2004 | Slattery et al. | |
| 8,869,836 | B2 * | 10/2014 | Miller | B64D 37/10 137/13 |
| 2002/0000343 | A1 | 1/2002 | Paschereit | |
| 2005/0194207 | A1 * | 9/2005 | Neurit, Jr. | F25B 49/00 181/250 |
| 2009/0043288 | A1 * | 2/2009 | Petrakis | A61M 31/002 604/890.1 |
| 2010/0180583 | A1 | 7/2010 | Takahashi et al. | |

FOREIGN PATENT DOCUMENTS

| | | |
|---|---|---|
| DE | 10026121 | 11/2001 |
| DE | 102008020721 | 10/2009 |
| DE | 102012217931 | 4/2014 |
| EP | 2157296 | 2/2010 |
| GB | 537040 | 11/1939 |
| JP | S51-022113 | 2/1976 |
| JP | S61129414 | 6/1986 |
| JP | 2002-129982 | 5/2002 |
| WO | WO 2009/151135 | 12/2009 |

OTHER PUBLICATIONS

Office Action dated Feb. 19, 2018 which issued in the corresponding Japanese Patent Application No. 2017-520913.
Office Action dated Nov. 9, 2018 issued in Chinese Patent Application No. 201580060397.6.
Office Action dated Jan. 28, 2019 issued in Korean Patent Application No. 10-2017-713182.
Office Action dated Apr. 1, 2019 issued in Japanese Patent Application No. 2017-5209130.

* cited by examiner

EXHAUST GAS AFTERTREATMENT DEVICE AND EXHAUST GAS AFTERTREATMENT METHOD

PRIORITY CLAIM

This is a U.S. national stage of application No. PCT/EP2015/074365, filed on 21 Oct. 2015. Priority is claimed on the following application(s): Country: Germany, Application No.: 10 2014 016 448.9, filed: 6 Nov. 2014, the content of which is/are incorporated herein by reference in its entirety.

FIELD OF THE INVENTION

The invention relates to an exhaust-gas aftertreatment device and a method for exhaust-gas aftertreatment.

BACKGROUND OF THE INVENTION

It is known from practice that both emission control devices such as catalytic converters or exhaust gas scrubbers and silencers can be arranged downstream of an internal combustion engine as exhaust-gas aftertreatment modules. The catalytic converters are used in particular for nitrogen removal and/or desulphurization of the exhaust gas and therefore the reduction of nitrogen-oxide emissions and sulphur-oxide emissions. The silencers are used for noise reduction and thus reducing sound emissions.

Silencers known from practice are typically positioned downstream of an emission control device and realized as what are known as resonance or lambda/4 silencers, which are based on the fact that chambers of the silencers have a depth or length adapted to the frequency of the exhaust noise to be damped. Silencers of this type have a narrow-banded damping action however, so that in particular in the case of engines which are operated with variable speed and therefore have different exhaust frequencies, it is not possible to realize a satisfactory exhaust sound damping.

In order to provide silencers with wide-banded damping action for exhaust sound damping, it is known from the prior art to equip silencers with a plurality of chambers, which are released via valves, as a result of which the depth of the chambers can be adapted to the frequency of the exhaust sound to be damped.

Silencers of this type have the disadvantage however, that movable parts are located in the exhaust-gas flow, which have a strong tendency to corrosion in particular if the internal combustion engine, the exhaust sound of which is to be damped, is operated using high-sulphur fuels. Furthermore, in silencers of this type, only a plurality of narrow-banded frequency ranges can be subjected to an effective sound damping, an infinitely variable adaptation of the damping action of the silencer to different frequency ranges of the exhaust sound to be damped is not possible.

DE 196 11 133 A1 and DE 196 19 173 C1 in each case disclose silencers with movable parts exposed to the exhaust-gas flow.

On this basis, it is one object of the present invention to create a novel exhaust-gas aftertreatment device and method for exhaust-gas aftertreatment.

SUMMARY OF THE INVENTION

The exhaust-gas aftertreatment device according to the invention comprises a housing; an exhaust-gas chamber, defined by the housing, through which exhaust gas flows continuously, into which exhaust gas flows via an inlet and out of which exhaust gas flows via an outlet; and a sound damping chamber, defined by the housing and coupled with the exhaust-gas chamber, preferably via at least one connecting element, in which sound damping chamber a fluid or a pourable solid is accommodated with a fill level, which depends on the frequency of the exhaust sound to be damped.

In the exhaust-gas aftertreatment device according to the invention, the fill level of the fluid or the pourable solid in the sound damping chamber, which is coupled with the exhaust-gas chamber through which exhaust gas flows, can be set in an infinitely variable manner, so that ultimately, the sound damping action of the exhaust-gas aftertreatment device can be set in an infinitely variable manner. As a result, the sound damping action can be adapted in a flexible manner to a wide range of exhaust sound frequencies. Thus, a particularly effective sound damping is even possible in the case of internal combustion engines, which are operated with a wide range of engine speeds, specifically whilst avoiding the disadvantages of silencers known from the prior art with components that can be moved in the exhaust-gas flow.

According to an advantageous embodiment, the fill level of the fluid, which is preferably a liquid, or of the pourable solid, which is preferably a granulated material, in the sound damping chamber can be set by an inflow of the sound damping chamber and an outflow of the sound damping chamber, wherein a control device preferably automatically determines and, by the inflow and/or outflow, automatically sets the fill level for the sound damping chamber, which is to be adapted to the frequency to be damped, as a function of the frequency of the exhaust gas to be damped. The fill level required in the sound damping chamber for optimum sound damping can be determined and set automatically by the control device, as a function of the frequency of the exhaust gas to be damped. This enables an effective sound damping.

According to a further advantageous embodiment, the sound damping chamber is constructed to be U-shaped in cross section, and has two coupled sub-chambers in a lower section of the same, wherein a first sub-chamber communicates with the inflow and the outflow of the sound damping chamber, and wherein a second sub-chamber, which is coupled with the first sub-chamber, is constructed to be either open at the top or closed at the top or can be closed. The sound damping action of the exhaust-gas aftertreatment device can be improved further herewith.

Preferably, at least one emission control device, particularly a catalytic converter and/or an exhaust gas scrubber, is arranged in the exhaust-gas chamber through which exhaust gas flows. If an emission control device is positioned or integrated in the exhaust-gas chamber, through which exhaust gas flows, the exhaust-gas aftertreatment device according to the invention is used not only for sound damping, but also for emission control. The space requirements of such exhaust-gas aftertreatment devices can be reduced herewith.

BRIEF DESCRIPTION OF THE DRAWINGS

Exemplary embodiments of the invention are explained in more detail on the basis of the drawing in which.

DETAILED DESCRIPTION OF THE PRESENTLY PREFERRED EMBODIMENTS

The invention relates to an exhaust-gas aftertreatment device for an internal combustion engine, particularly for a marine diesel internal combustion engine operated using heavy fuel oil.

Figure 1:
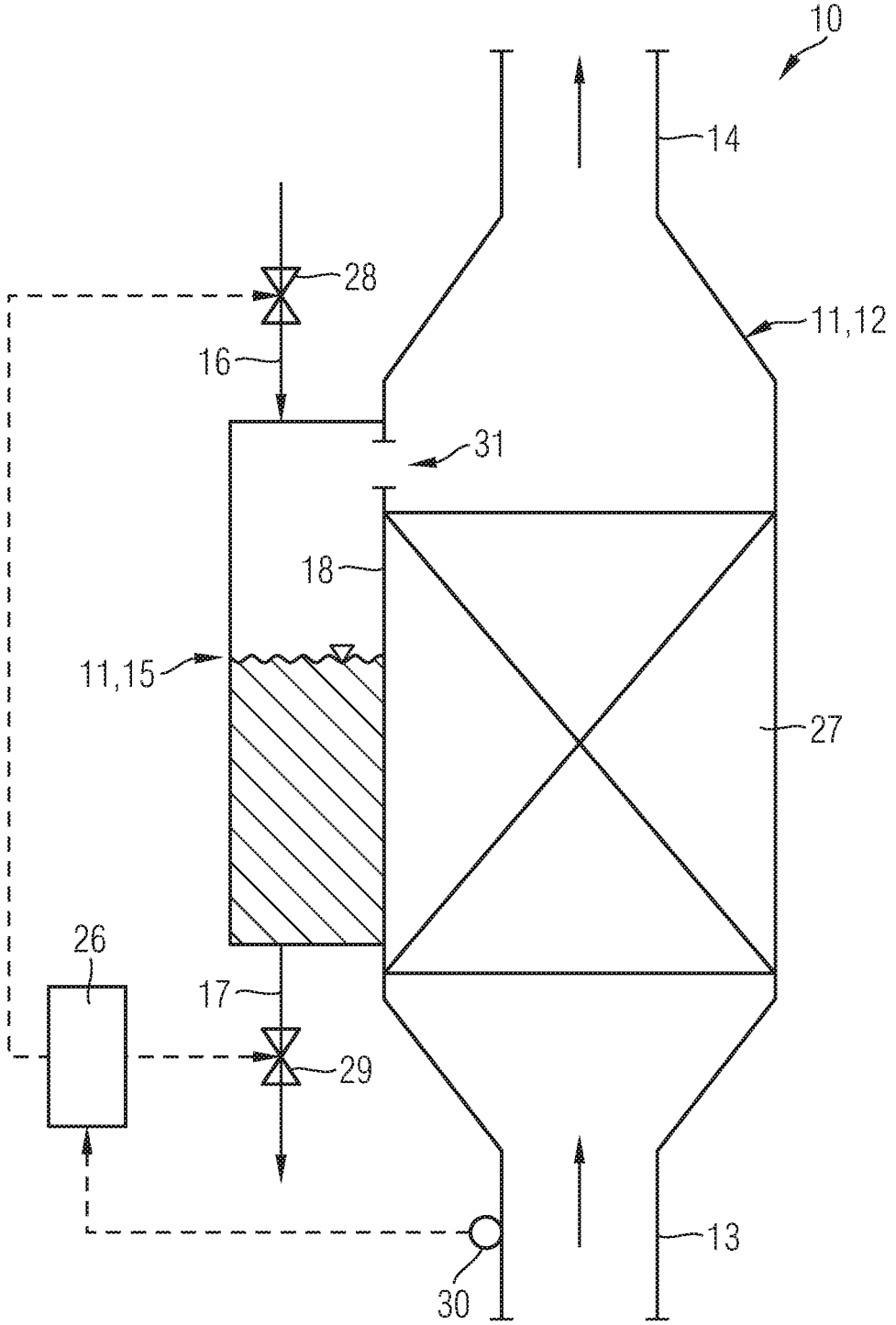
FIG. 1 is a schematized illustration of a first exhaust-gas aftertreatment device according to the invention.

FIG. 1 shows a schematic illustration of a first exemplary embodiment of an exhaust-gas aftertreatment device 10 according to the invention for an internal combustion engine, particularly for a marine diesel internal combustion engine operated using heavy fuel oil.

The exhaust-gas aftertreatment device 10 comprises a housing 11. The housing 11 defines an exhaust-gas chamber 12 on one side, through which exhaust gas flows continuously, into which exhaust-gas chamber exhaust gas flows via an inlet 13 and out of which exhaust gas flows via an outlet 14, and a sound damping chamber 15 on the other side.

The sound damping chamber 15 is coupled with the exhaust-gas chamber 12.

A fluid, particularly a liquid, or a pourable solid, particularly a granulated material, is accommodated in the sound damping chamber 15 with a fill level, which depends on the frequency of the exhaust sound to be damped. If the frequency of the exhaust sound to be damped changes for example as a consequence of a changing load of the internal combustion engine, then the damping action of the exhaust-gas aftertreatment device 10 can be adapted to the changing frequency of the exhaust sound by a simple change of the fill level of the fluid or of the pourable solid in the sound damping chamber 15. The damping range or the damping action of the exhaust-gas aftertreatment device 10 can be set in an infinitely variable manner as a result.

The fluid, which is accommodated in the sound damping chamber 15 with a defined fill level, is preferably water. Alternatively to the fluid, the pourable solid, granulated material in particular, can also be accommodated in the sound damping chamber 15 with a fill level dependent on the frequency of the exhaust sound to be damped.

According to the exemplary embodiment of FIG. 1, the liquid or the pourable solid can be supplied to the sound damping chamber 15 by an inflow 16 and can be discharged from the sound damping chamber 15 by an outflow 17. The fill level of the liquid or of the pourable solid inside the sound damping chamber 15 can be set by valves 28, 29 assigned to the inflow 16 and to the outflow 17.

As stated already, the sound damping chamber 15 is coupled with the exhaust-gas chamber 12, preferably by at least one connecting member or device. According to FIG. 1, the exhaust-gas chamber 12 and the sound damping chamber 15 are separated by a common housing wall 18 or a housing wall section of the housing 11, wherein the same are coupled by at least one flow connection constructed as an opening or a recess 31 in the housing wall 18. The recess 31 is in this case, according to FIG. 1, introduced into the housing wall 18 in such a manner that the same is positioned above the fill level of the liquid or of the granulated material in the sound damping chamber 15.

A control device 26 is shown in FIG. 1, which automatically determines and, by controlling the valves 28, 29, automatically sets the optimum fill level for the sound damping for the liquid or the pourable solid inside the sound damping chamber 15 as a function of the frequency of the exhaust sound to be damped. The frequency of the exhaust sound to be damped can in this case be determined arithmetically by the control device 26 for example by a model, on the other hand it is possible, with the aid of a measuring device 30, to measure the frequency of the exhaust sound to be damped and to provide a corresponding measured value to the control device 26. The measuring device 30 can for example be a microphone or else a strain gauge assigned to the exhaust-gas chamber 12 of the exhaust-gas aftertreatment device 10.

In the exemplary embodiment shown in FIG. 1, an emission control device 27 is arranged inside the exhaust-gas chamber 12 of the housing 11, through which exhaust gas flows continuously. The emission control device can for example be a catalytic converter or else an exhaust gas scrubber. One or more emission control devices 27 can be arranged in the exhaust-gas chamber 12.

If an exhaust gas scrubber is integrated in the exhaust-gas chamber 12 of the housing 11 of the exhaust-gas aftertreatment device 10, the sound damping chamber 15 of the housing 11 of the exhaust-gas aftertreatment device 10 is filled with water in particular, in order to provide the sound damping action. In this case, exhaust-gas temperatures are namely considerably lower than the boiling point of the water accommodated in the sound damping chamber 15, so that the vaporization or evaporation of the water in the sound damping chamber 15, which occurs at higher exhaust-gas temperatures, is of lesser importance. At high exhaust-gas temperatures, a pourable solid, particularly a granulated material, is preferably used in the sound damping chamber 15, in order to provide the desired sound damping action in the desired frequency range by the fill level in the sound damping chamber 15.

To increase the sound damping action, the chambers, namely the exhaust-gas chamber 12 and/or the sound damping chamber 15, or housing walls of the housing delimiting the same, can be provided or clad internally and/or externally with an absorbent.

Figure 2:
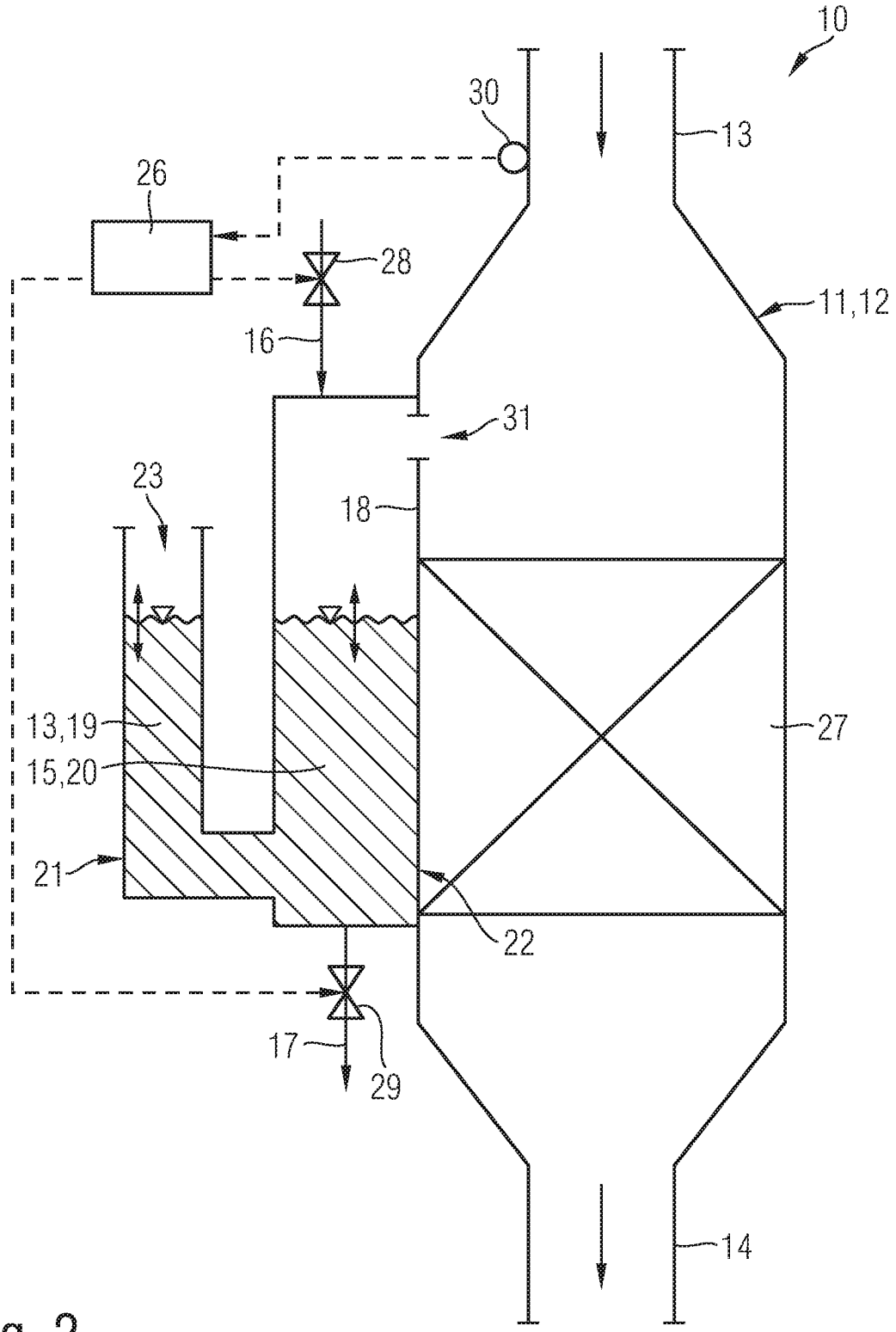
FIG. 2 is a schematized illustration of a second exhaust-gas aftertreatment device according to the invention.

FIG. 2 shows a schematic illustration of an exhaust-gas aftertreatment device 10 according to the invention according to a second exemplary embodiment of the invention, wherein to avoid unnecessary repetitions, the same reference numbers are used for the same modules. Only differences between the exemplary embodiments of FIGS. 1 and 2 are covered in the following.

In the exemplary embodiment of FIG. 2, the sound damping chamber 15 comprises two sub-chambers 19, 20, which are coupled in lower regions 21, 22 with the formation of a sound damping chamber 15 which is U-shaped in cross section. The first sub-chamber 20 of the sound damping chamber 15 in this case communicates with the inflow 16 and the outflow 17 and is coupled with the exhaust-gas chamber 12 by at least one recess 31 in the housing wall 18, which separates the first sub-chamber 20 from the exhaust-gas chamber 12. The second sub-chamber 19, which is coupled with the first sub-chamber 20 in the lower section 21, is constructed to be open at the upper end 23 in FIG. 2. If in FIG. 2, a liquid, for example water, is accommodated in the sound damping chamber 15, a fill level is formed in both sub-chambers 19, 20 of the sound damping chamber 15. Exhaust gas, which flows through the exhaust-gas chamber 12 of the housing 11, excites the liquid in the sound damping chamber 15 to vibrate, wherein the liquid column located in the second sub-chamber 19 can vibrate freely with respect to the atmosphere, as the second sub-chamber 19 of the flow chamber 15 is constructed to be open at the top in the exemplary embodiment of FIG. 2.

Kinetic energy is drawn from the vibrating exhaust-gas column by the vibrating liquid column and the sound emission is reduced as a result.

A plurality of silencer chambers 15 can be coupled with the housing 11 and the free path length may be different in the individual chambers 15 above the fluid or the granulated material. Thus, a plurality of frequencies can be damped.

In FIG. 1, the flow direction of the exhaust gas through the exhaust-gas chamber 12 is directed from the bottom upwards, wherein in FIG. 2 the same is directed from the top downwards. In FIG. 1, the opening 31, which couples the sound damping chamber 15 with the exhaust-gas chamber 12, is positioned downstream of the emission control device 27 as viewed in the flow direction of the exhaust gas. In FIG. 2, this opening 31 is positioned upstream of the emission control device 27 as viewed in the flow direction of the exhaust gas.

Figure 3:
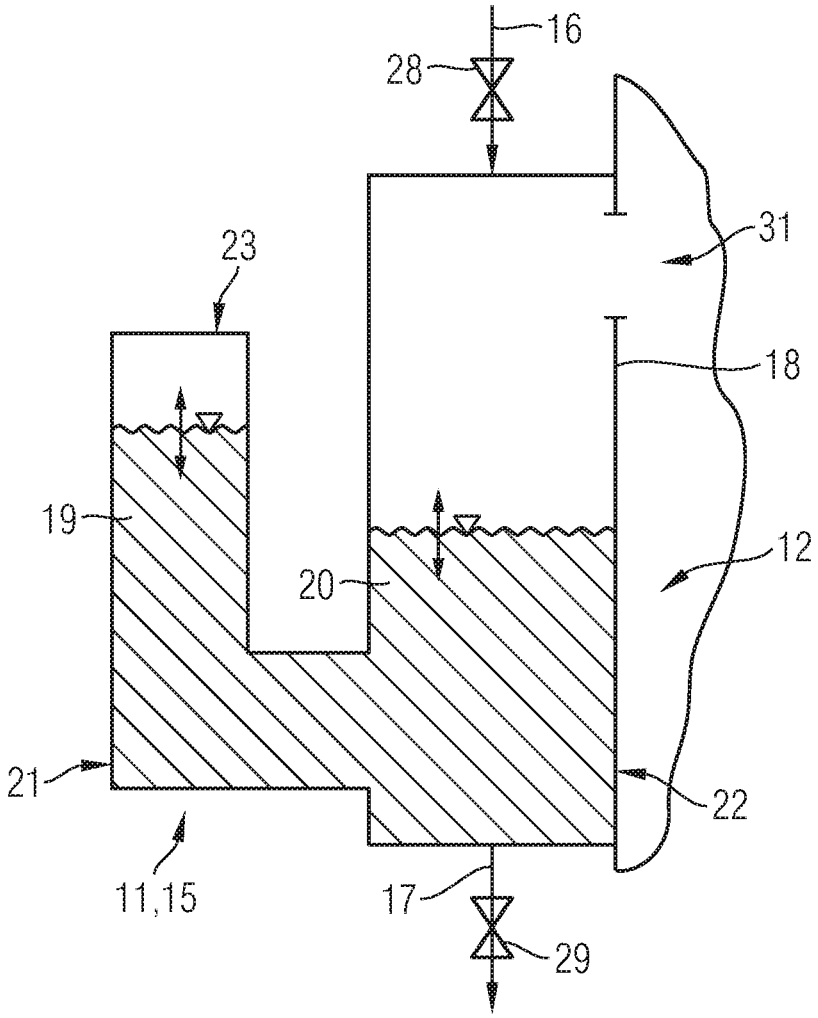
FIG. 3 shows a detail of a third exhaust-gas aftertreatment device according to the invention.
Figure 4:
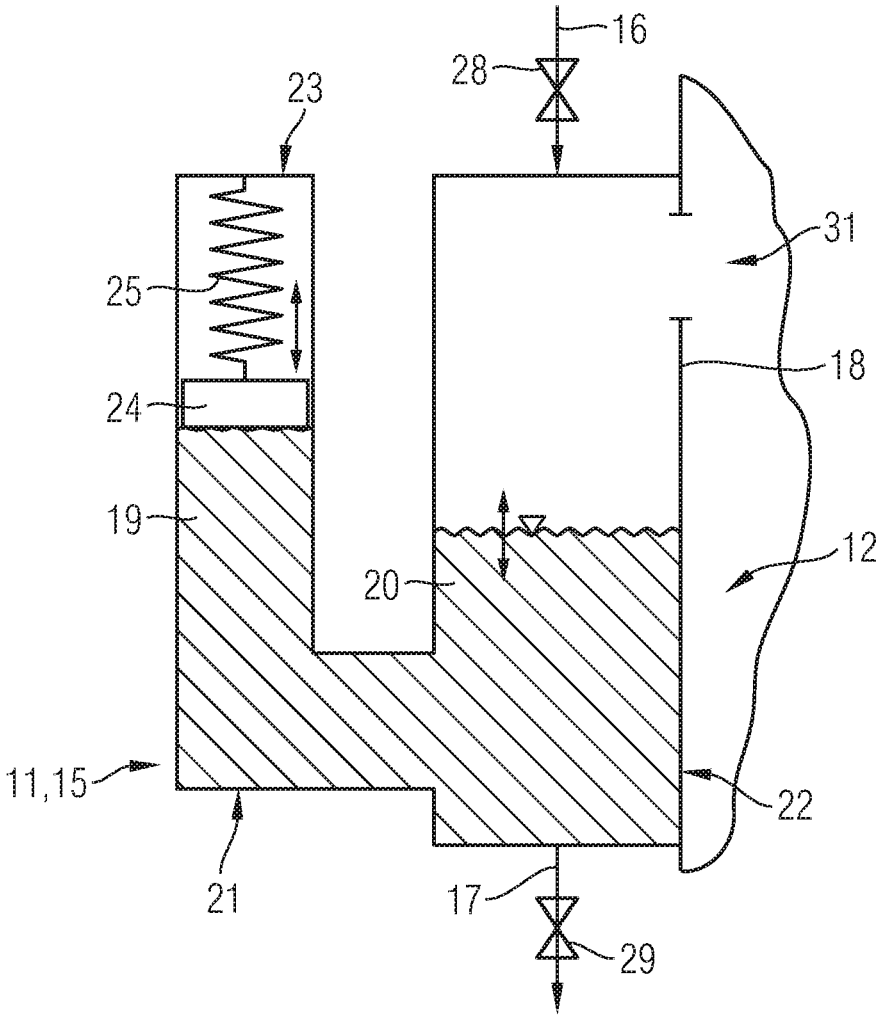
FIG. 4 shows a detail of a fourth exhaust-gas aftertreatment device according to the invention.

FIGS. 3 and 4 show modifications of the exemplary embodiment of FIG. 2, in which the second sub-chamber 19 is constructed to be closed at the upper end 23, wherein in FIG. 3, the liquid column in the second sub-chamber 19 operates counter to a gas bubble enclosed in the second sub-chamber 19 and in FIG. 4 operates counter to a float 24 loaded by a spring element 25. As a result even more kinetic energy can be drawn from the vibrating exhaust-gas column. As a result, the damping can be increased further.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. An exhaust-gas aftertreatment device (10) for an internal combustion engine, comprising:

a housing (11);

an exhaust-gas chamber (12) defined by the housing (11) for permitting exhaust gas to flow continuously through the housing (11);

an inlet (13) for permitting exhaust gas to flow into the housing and an outlet (14) for permitting exhaust gas to flow out of the housing (11);

a sound damping chamber (15), defined by the housing (11) and constructed to receive a liquid or a pourable solid at an infinitly variable fill level of the liquid or the pourable solid depending on the frequency of an exhaust sound to be damped and to permit the exhaust gas to directly contact the liquid or pourable solid; and a flow connection (31) located above the fill level for connecting the sound damping chamber (15) with the exhaust-gas chamber (12).

2. The exhaust-gas aftertreatment device according to claim 1, additionally comprising a control device (26) for setting the fill level in the sound damping chamber (15) by an inflow (16) of liquid into the sound damping chamber (15) and an outflow (17) of liquid out of the sound damping chamber (15).

3. The exhaust-gas aftertreatment device according to claim 2, wherein the control device (27) is constructed for automatically determining and, based on the inflow (16) and/or outflow (17), automatically setting the fill level for the sound damping chamber (15), so that the fill level is adapted to the frequency to be damped, as a function of the frequency to be damped.

4. The exhaust-gas aftertreatment device according to claim 1, wherein the exhaust-gas chamber (12) and the sound damping chamber (15) are coupled by at least one connection opening.

5. The exhaust-gas aftertreatment device according to claim 1, additionally comprising a common housing wall (18) having a recess therein, the housing wall (18) separating the exhaust-gas chamber (12) and the sound damping chamber (15).

6. The exhaust-gas aftertreatment device according to claim 1, wherein the sound damping chamber (15) is constructed to be U-shaped in cross section, and has a first and a second coupled sub-chamber (19, 20) in a lower section (21, 22) of the sound damping chamber (15).

7. The exhaust-gas aftertreatment device according to claim 6, wherein the sound damping chamber (15) comprises an inflow (16) and an outflow (17), and wherein the first sub-chamber (20) communicates with the inflow (16) and the outflow (17) of the sound damping chamber (15).

8. The exhaust-gas aftertreatment device according to claim 7, wherein the first sub-chamber (20) of the sound damping chamber (15) is coupled with the exhaust-gas chamber (12).

9. The exhaust-gas aftertreatment device according to claim 7, wherein the second sub-chamber (19), which is coupled with the first sub-chamber (20), is constructed to be open at the top.

10. The exhaust-gas aftertreatment device according to claim 7, wherein the second sub-chamber (19), which is coupled with the first sub-chamber (20), is constructed to be closed at the top.

11. The exhaust-gas aftertreatment device according to claim 10, additionally comprising a float (24) loaded by spring element (25); and wherein a fill level in the second sub-chamber (19) vibrates counter to the float (24).

12. The exhaust-gas aftertreatment device according to claim 1, additionally comprising at least one emission control device (27), arranged in the exhaust-gas chamber (12).

13. The exhaust-gas aftertreatment device according to claim 1, additionally comprising a plurality of sound damping chambers (15) coupled with the housing (11), the plurality of sound damping chambers (15) being filled with fluid or granulated material so as to define a free path length above the fluid or granulated material and wherein the free path length differs in the individual chambers (15).

14. The exhaust-gas aftertreatment device according to claim 8, wherein the second sub-chamber (19), which is coupled with the first sub-chamber (20), is constructed to be open at the top.

15. The exhaust-gas aftertreatment device according to claim 8, wherein the second sub-chamber (19), which is coupled with the first sub-chamber (20), is constructed to be closed at the top.

16. The exhaust-gas aftertreatment device according to claim 1, wherein the emission control device (27) is a catalytic converter and/or an exhaust gas scrubber.

17. A method for exhaust-gas aftertreatment, using an exhaust-gas aftertreatment device according to claim 1, the method comprising flowing exhaust gas continuously through an exhaust-gas chamber (12), coupling a sound damping chamber (15) with the exhaust-gas chamber (12) and filling the sound damping chamber with a liquid or a pourable solid so that a fill level in the sound damping chamber (15) depends on the frequency of the exhaust sound to be damped.

18. The exhaust-gas aftertreatment device according to claim 1, additionally comprising a control device (26) for setting the fill level in the sound damping chamber (15) by an inflow valve (28) of liquid or a pourable solid into the sound damping chamber (15) and an outflow valve (29) of liquid or pourable solid out of the sound damping chamber (15).

* * * * *